US010159619B2

(12) United States Patent
Lee et al.

(10) Patent No.: US 10,159,619 B2
(45) Date of Patent: Dec. 25, 2018

(54) HIP CONTINUOUS PASSIVE MOTION DEVICE AND RELATED METHODS

(75) Inventors: Laura W. Lee, Atlanta, GA (US); Kenneth A. Garrett, Yorktown, VA (US); Muhaimeinul Khan, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 253 days.

(21) Appl. No.: 13/178,147

(22) Filed: Jul. 7, 2011

(65) Prior Publication Data

US 2012/0006335 A1 Jan. 12, 2012

Related U.S. Application Data

(60) Provisional application No. 61/361,937, filed on Jul. 7, 2010.

(51) Int. Cl.
*A61G 15/00* (2006.01)
*A61H 1/02* (2006.01)

(52) U.S. Cl.
CPC ..... *A61H 1/0244* (2013.01); *A61H 1/0262* (2013.01); *A61H 2201/0157* (2013.01); *A61H 2201/0176* (2013.01); *A61H 2201/1207* (2013.01); *A61H 2201/164* (2013.01); *A61H 2201/1676* (2013.01)

(58) Field of Classification Search
CPC ..... A61G 13/0063; A61G 13/0081; A61G 13/123; A61H 1/0222; A61H 1/0244; A61H 1/0255; A61H 2001/0248; A61H 2001/0251
USPC ..... 602/23–25; 128/845; 601/34; 482/133–137, 907
See application file for complete search history.

(56) References Cited

U.S. PATENT DOCUMENTS

| | | | | |
|---|---|---|---|---|
| 4,509,509 | A | 4/1985 | Bouvet | |
| 4,520,827 | A | 6/1985 | Wright | |
| 4,549,534 | A | 10/1985 | Zagorski | |
| 4,665,899 | A | 5/1987 | Farris | |
| 4,834,073 | A | 5/1989 | Bledsoe | |
| 5,122,106 | A * | 6/1992 | Atwood et al. | 482/131 |
| 5,207,216 | A * | 5/1993 | Sweeny | A61H 1/02 601/5 |
| 5,277,681 | A * | 1/1994 | Holt | 482/112 |
| 5,280,783 | A | 1/1994 | Focht | |
| 5,325,849 | A | 7/1994 | Rugo | |
| 5,901,581 | A * | 5/1999 | Chen et al. | 601/34 |
| 2002/0193710 | A1 | 12/2002 | Main | |
| 2010/0048364 | A1 | 2/2010 | Reyes | |

* cited by examiner

*Primary Examiner* — Kari Rodriquez
(74) *Attorney, Agent, or Firm* — Robert J. Decker

(57) ABSTRACT

A system for providing continuous passive motion of a subject's leg through hip extension and flexion. The system may have an actuator, a leg support member, a retention surface, and a base. The leg support member may be a support frame with a proximal member and a distal member. The subject places his/her leg on the leg support and the actuator provides a moment of force to the subject's upper leg to move the upper leg through the desired range of motion. The system may be controlled allowing the device to operate at different speeds and for different ranges of motion.

12 Claims, 21 Drawing Sheets

HIP CONTINUOUS PASSIVE MOTION DEVICE AND RELATED METHODS

RELATED APPLICATIONS

The present application claims priority from U.S. Provisional Application Ser. No. 61/361,937, filed Jul. 7, 2010, entitled "Hartford Hip Continuous Passive Range of Motion (Hip CPM) Device and Related Method;" the disclosure of which is hereby incorporated by reference herein in its entirety.

FIELD OF THE INVENTION

The present invention relates generally to a system and methods for providing hip extension for a patient, and to an apparatus and methods for providing continuous passive motion of a patient's hip.

BACKGROUND OF THE INVENTION

With the increase of older adults in the United States, the incidence of hip fractures and hip replacements is also increasing, with approximately 350,000 hip fractures per year and 234,000 total hip replacements per year. While studies have demonstrated reduced hip extension even in healthy elderly adults compared to young adults, older and immobile adults who have undergone hip surgery are at greater risk for loss of hip extension and joint contractures. Furthermore, only fifty percent of patients with hip fractures return to their pre-fracture level of physical function after hip surgery. There is a need to design a device that will accelerate the process of hip rehabilitation by increasing hip range of motion and consequently decreasing hip swelling, stiffness, and pain. Because of hospital staffing limitations, manual physiotherapy to increase range of motion is difficult and an automated device that provides the desired range of motion is needed. Currently knee continuous passive motion (CPM) devices are used to increase hip joint flexibility, but the knee CPM devices are placed on top of the beds and cannot provide any hip extension range. Currently, knee CPM devices are used after hip surgery to improve hip flexibility; however, these devices do not provide any hip extension movement and thus is an incomplete solution.

SUMMARY OF THE INVENTION

An aspect of an embodiment of the present invention is directed to, among other things, a system and methods for moving a subject's leg. It should be appreciated that throughout the instant specification, the term upper leg denotes the portion of the leg which rotates or moves about the hip as shown in FIGS. 1A and 1B. The system includes an apparatus configured to apply a moment of force to the subject's upper leg and provides for extension of the subject's hip. The apparatus may also include a leg support member configured to support the subject's upper leg during the movement. The leg support member may be a support frame. The support frame may include a proximal and a distal member and a foot rest. The apparatus may include an actuator, the actuator in communication with the apparatus generating the force to provide movement of the apparatus. The system may further include an arm, wherein the arm provides the communication between the actuator and the support member. The system may also include a retention surface for supporting a portion of the subject other than the moving upper leg. The retention surface may be proximate to a bed. The retention surface may be a bed, board, gurney, mattress, frame, surface, platform, ledge, shelf, offshoot, offset, extension, or pad. The system may include the actuator being disposed on the retention surface. Another feature may include the apparatus being disposed on a base for providing stability. The moment of force to the subject's upper leg has a rotational component that is rotational about the torso. The moment of force provides a rotational component relative to the subject's hip throughout the entire range of motion of the extension of the subject's hip.

An aspect of an embodiment of the present invention provides, among other things, a CPM device to aid in hip rehabilitation by providing for hip extension and flexion. The range of motion mimics hip range of motion during gait, thus helping patients achieve quicker recovery of hip function after surgery. An aspect of an embodiment of the present invention also reduces hip pain and stiffness post-operation. The device is also easy to use, adjustable in that it can accommodate patients of varying size, adjustable in that it can perform at different speeds and range of motions, and maintains safe levels of motion not easily achieved by physical therapists and nursing staff. Moreover, the device may also be portable and easy to store.

An aspect of an embodiment of the present invention provides a method (and related device) whereby the patient's upper leg is rotated clockwise or counter-clockwise from the vertical axis of the retention surface so that he/she can have the leg in position to fit the device. In other words, it's the device and the method for the patient (i.e., subject) to use the device and attain hip extension. The vertical axis is defined as being essentially transverse to the retention surface (i.e., essentially perpendicular to the bed's surface for example).

These and other objects, along with advantages and features of various aspects of embodiments of the invention disclosed herein, will be made more apparent from the description, drawings and claims that follow.

BRIEF DESCRIPTION OF THE DRAWINGS

The foregoing and other objects, features and advantages of the present invention, as well as the invention itself, will be more fully understood from the following description of preferred embodiments, when read together with the accompanying drawings, in which.

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF THE INVENTION

Figure 1A:
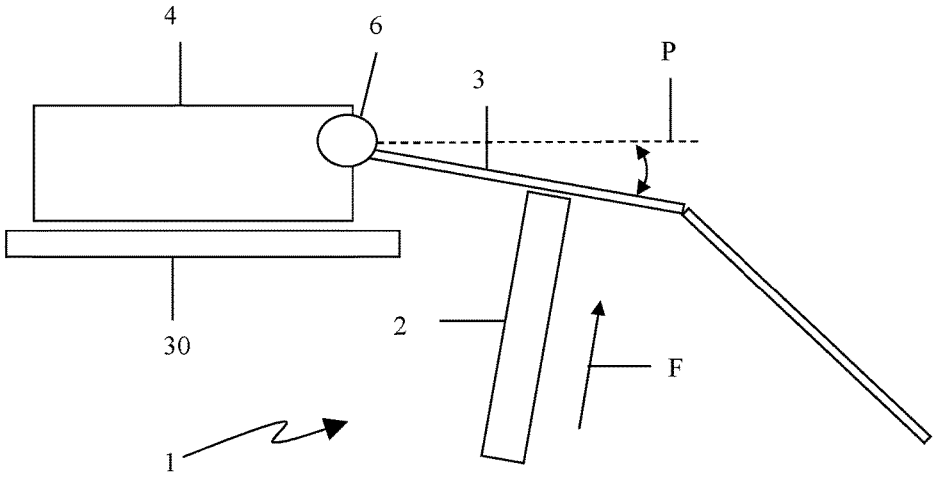
FIGS. 1A and 1B provide schematic side views of the system showing the apparatus and the force interacting with the subject's leg in accordance with an aspect of an embodiment of the present invention in a first position and second position, respectively.
Figure 1B:
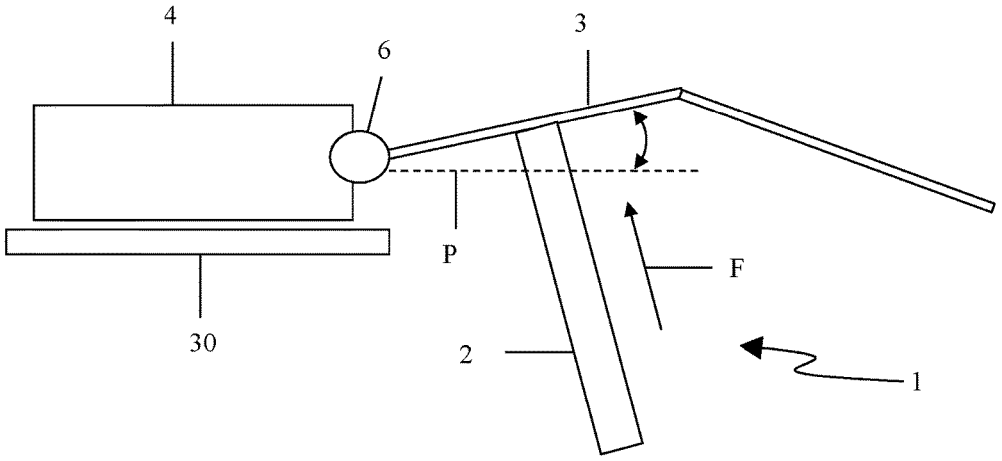

FIGS. 1A and 1B schematically show an aspect of an embodiment the system 1 whereby an apparatus 2 is engaged with the subject's upper leg 3. The subject's torso 4 with the hip 6 is disposed on a retention surface 30. The moment of force F is shown as the subject's upper leg 3 is moved from an extension position (FIG. 1A) to a flexion position (FIG. 1B). If the upper leg 3 is below the plane P of the subject's torso 4, as generally shown by the dotted line, then the hip is in an extended position (i.e., extension), as shown in FIG. 1A. If the upper leg 3 is above the plane P of the subject's torso 4, as generally shown by the dotted line, then the hip 6 is in a flexed position (i.e., flexion), as shown in FIG. 1B. Said differently, if the subject's upper leg 3 is displaced posterior to the plane P of the subject's torso 4, as generally shown by the dotted line, then the hip is in an extended position (i.e., extension), as shown in FIG. 1A. Similarly, if the upper leg 3 is displaced anterior to the plane P of the subject's torso 4, as generally shown by the dotted line, then the hip is in a flexed position (i.e., flexion), as shown in FIG. 1B. This movement mimics the natural gait of the subject, thus improving the results of rehabilitation. The terminology is only intended as a convention to help describe the motion. Other terminology could be used without changing the scope of the present disclosure. Again, it should be appreciated that throughout the instant specification, the term upper leg denotes the portion of the leg which rotates or moves about the hip as shown in FIGS. 1A and 1B. The hip 6 acts as a natural fulcrum or pivot point for the upper leg, thereby serving as an axis. As the moment of force F is applied to the upper leg, the leg rotates about the hip 6. The moment of force F provides a rotational component relative to the subject's hip throughout the entire range of motion of the device when in operation.

An aspect of an embodiment of the present invention provides a method for moving a subject's upper leg. The method may comprise: applying a moment of force to the subject's upper leg to rotate the subject's upper leg about the subject's hip to provide for extension of the subject's hip. For example, to use the device, a subject places the leg to be acted upon in the apparatus 2. The apparatus then moves the subject's upper leg through a range of motion by applying a moment of force to the subject's upper leg to rotate the subject's upper leg about the axis of the subject's hip to provide extension and flexion of the subject's hip. The apparatus provides the moment of force necessary for achieving the desired motion, so the device is a passive motion device. In an exemplary operating mode, because there is no need to stop the device at any point during the motion or for the subject to ever provide a force to cause the device to operate, it provides a continuous passive motion thereby defining a continuous passive motion (CPM) device. Alternatively, in an exemplary operating mode, the device may operate in a non-continuous manner or any combination of continuous or non-continuous manners.

Figure 2:
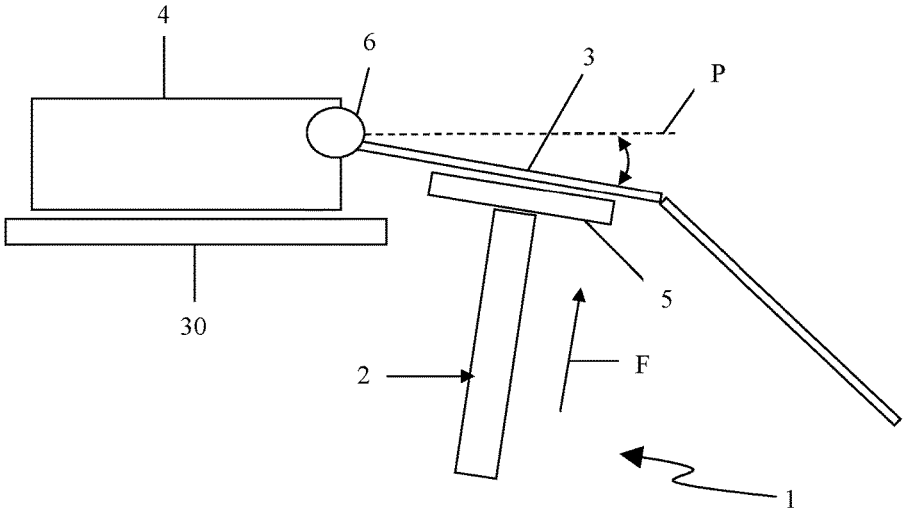
FIG. 2 provides a schematic side view of an aspect of an embodiment of the system showing the apparatus including the leg support member.

FIG. 2 schematically shows an aspect of an embodiment of the system 1 wherein the apparatus 2 is engaged with the subject's upper leg 3. Also shown is a leg support member 5 configured to support the subject's upper leg during the movement. The subject's torso 4 with the hip 6 is disposed on a retention surface 30.

Figure 3A:
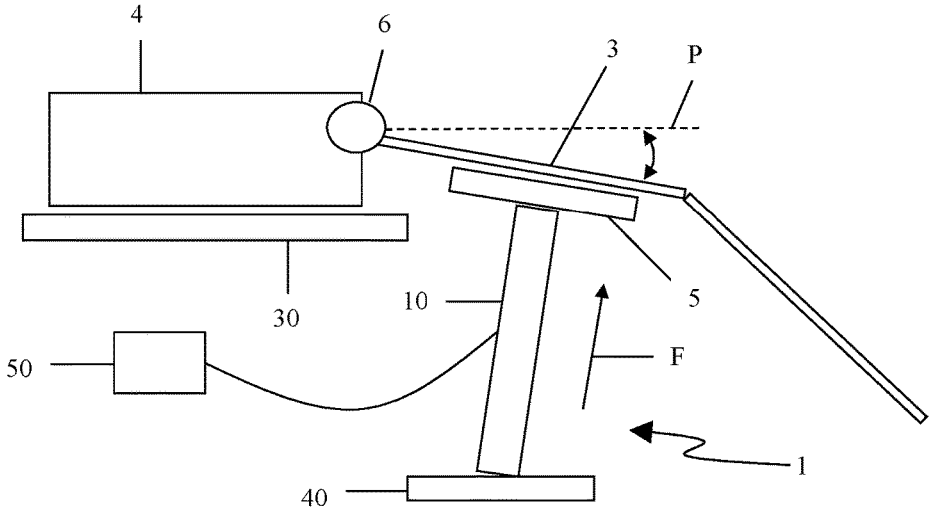
FIGS. 3A and 3B provide schematic side views illustrating an aspect of an embodiment the system further showing the actuator and the base.
Figure 3B:
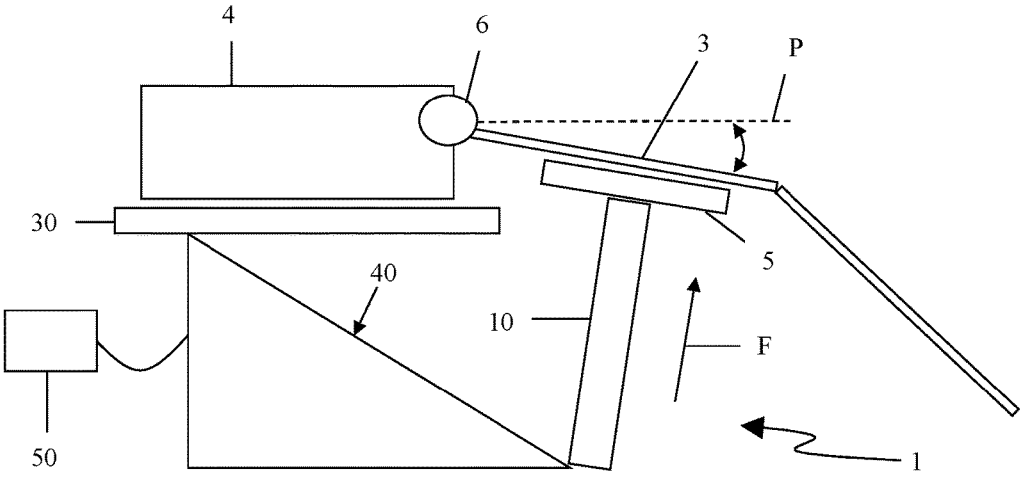

FIGS. 3A and 3B schematically show an aspect of an embodiment of the system 1 wherein the apparatus 2 is engaged with the subject's upper leg 3. The subject's torso 4 with the hip 6 is disposed on a retention surface 30. The apparatus further includes an actuator 10 and a base 40. The apparatus is disposed on a base 40 to improve or provide stability, for example, of the system. In FIG. 3B, the retention surface 30 is disposed on the base 40. A control box 50 is provided to control the motion of the device. The control box 50 is an electronic mechanism in an embodiment, but it can be any known means for controlling the actuator 10. The speed of the motion and the range of motion can be adjusted via control box 50, and there may be provided an emergency stop button. It should be appreciated that the control box 50 may be in communication with the actuator, base or any component (or combination of components) associated with the system 1 or discussed in this disclosure.

Figure 4:
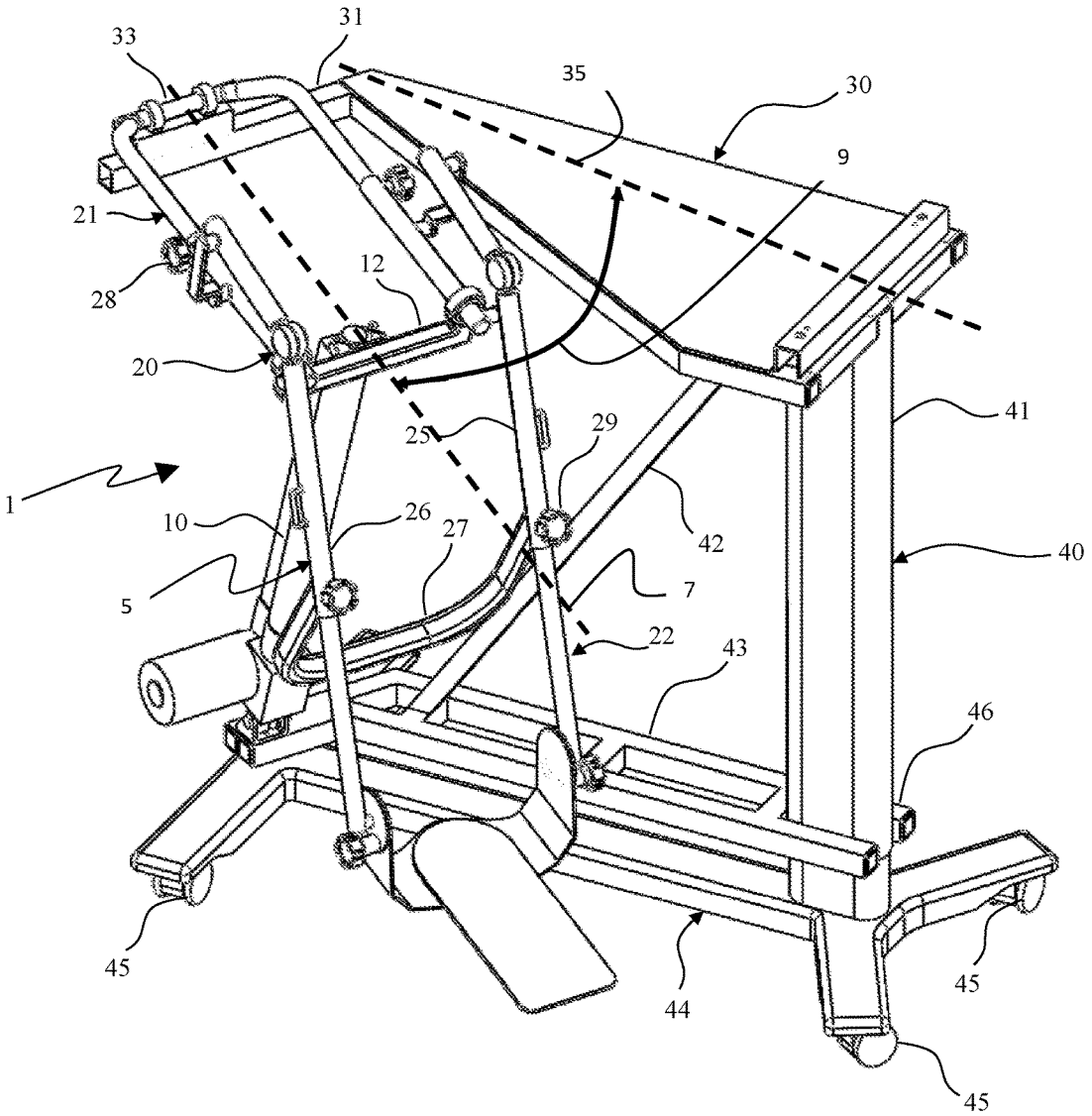
FIG. 4 is a front perspective view of an embodiment of the system.

FIG. 4 shows a detailed perspective view of an aspect of an embodiment of the system 1. The system 1 includes the apparatus (as discussed above) that includes the leg support member 5 (as also discussed, for example, above in FIGS. 1A, 1B, 2, 3A, and 3B, for example that is practiced in this embodiment and illustrated in this Figure at least in part as support frame 20. Also, the system 1 includes the apparatus (as discussed above) that further includes at least in part an actuator 10. The actuator connector bar 12 can be seen disposed between the actuator 10 and the support frame 20. The support frame 20 includes a proximal member 21 and a distal member 22. A foot rest 23 is disposed at the distal end of the support frame 20. The distal member is shown as having a distal medial bar 25 and a distal lateral bar 26. Also shown on the distal member is a support brace 27. Both the proximal and distal members are adjustable, as shown in this embodiment by proximal member adjustor 28 and distal member adjustor 29. The adjustable means can be any known means, component or mechanism in the art and the adjustable tightening knob is shown as just one example.

Still referring to FIG. 4, the retention surface 30 is generally aligned to define a retention surface longitudinal direction 35. The leg support member 5 is generally aligned to define leg support longitudinal direction 7 that is offset at an angle laterally from the retention surface longitudinal direction 35 to define a leg support longitudinal offset angle 9.

Still referring to FIG. 4, the retention surface 30 is disposed on the base 40 and the support frame 20 in this embodiment. Retention surface extension 31 is in communication with the distal member 21 creating rotation point 33. The base 40 includes an upright member 41, a diagonal member 42, and foundation member 43. The base 40 is disposed on a portable system 44 in this embodiment. The portable system 44 includes wheels 45, but any means for portability can be incorporated into the system. A base height adjustor 46 is shown in this embodiment at the connection point of the upright member 41 and the portable system 44, but it is only intended as an example. The base can be made adjustable by any known means.

Figure 5:
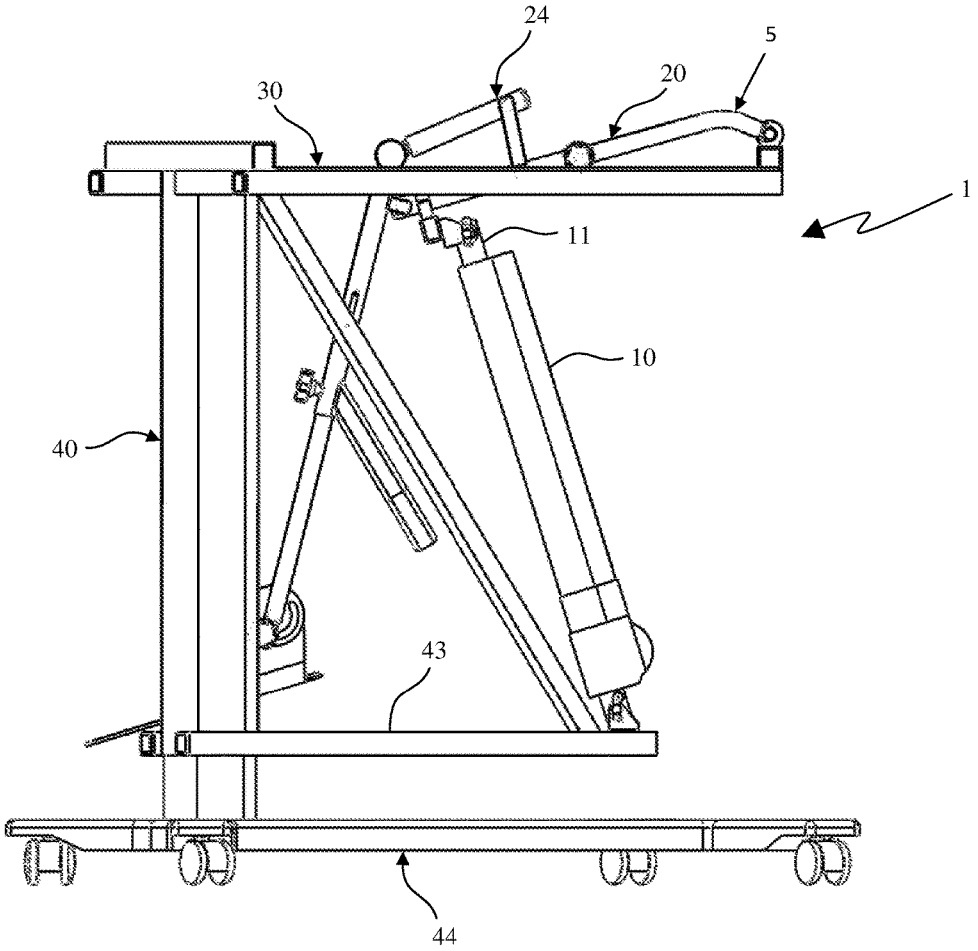
FIG. 5 is a side view of an embodiment of the system.

FIG. 5 is a side view of an aspect of an embodiment of an embodiment of the system 1 further showing an elbow connecting member 24 and an arm 11. The elbow connecting member is a means for connecting the proximal member 21 and the distal member 22 of the support frame 20. It is intended as an example as the two members and can be connected by any known means. The arm 11 is shown disposed between the actuator 10 and the actuator connector bar 12. The arm 11, for example, can be viewed in FIGS. 8A-8F as the device moves through its range of motion.

Figure 6:
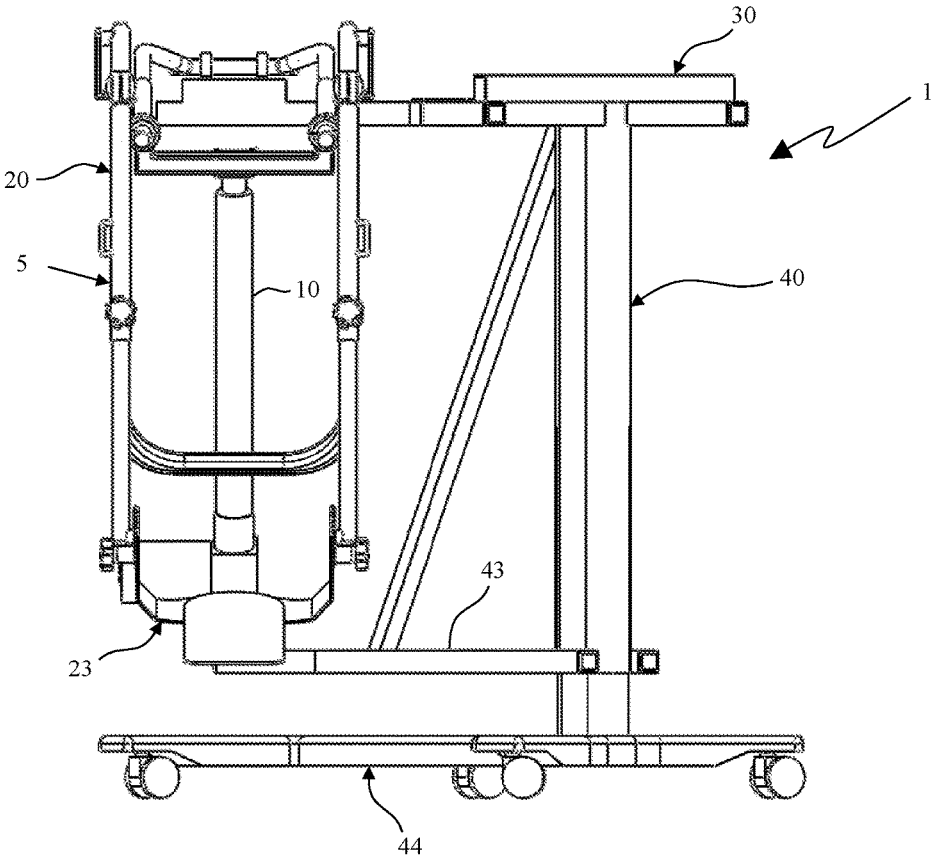
FIG. 6 is a front view of an embodiment of the system.
Figure 7:
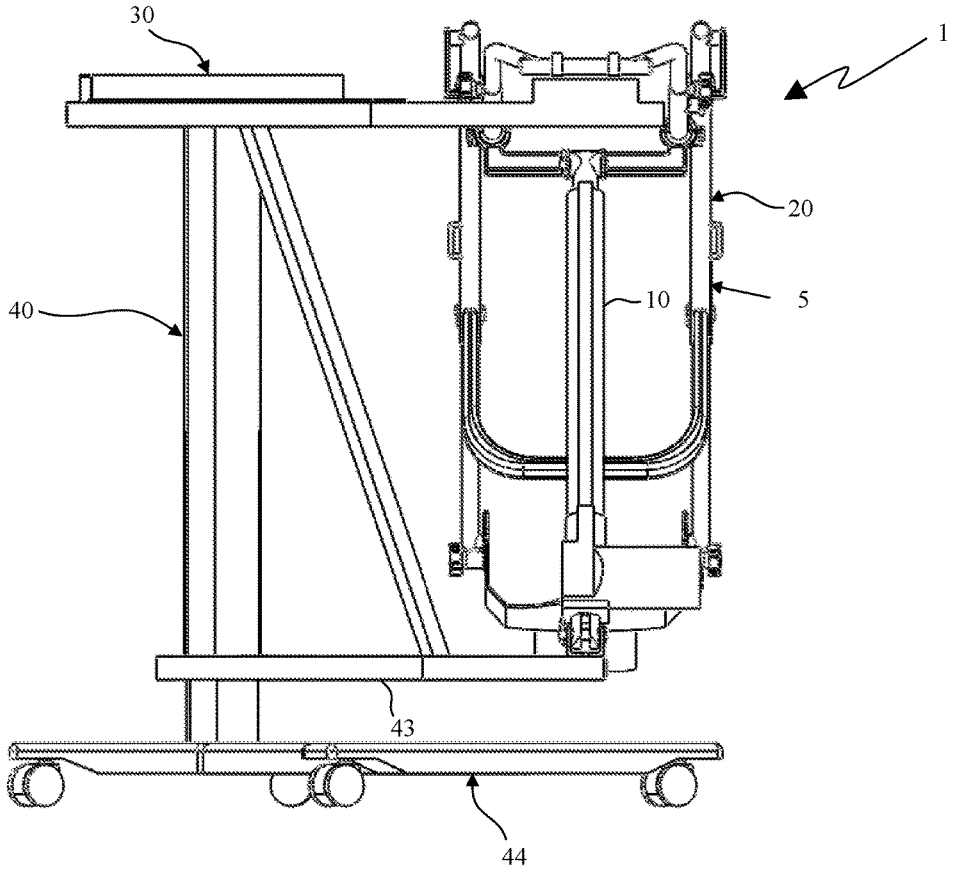
FIG. 7 is a rear view of an embodiment of the system.
Figure 8A:
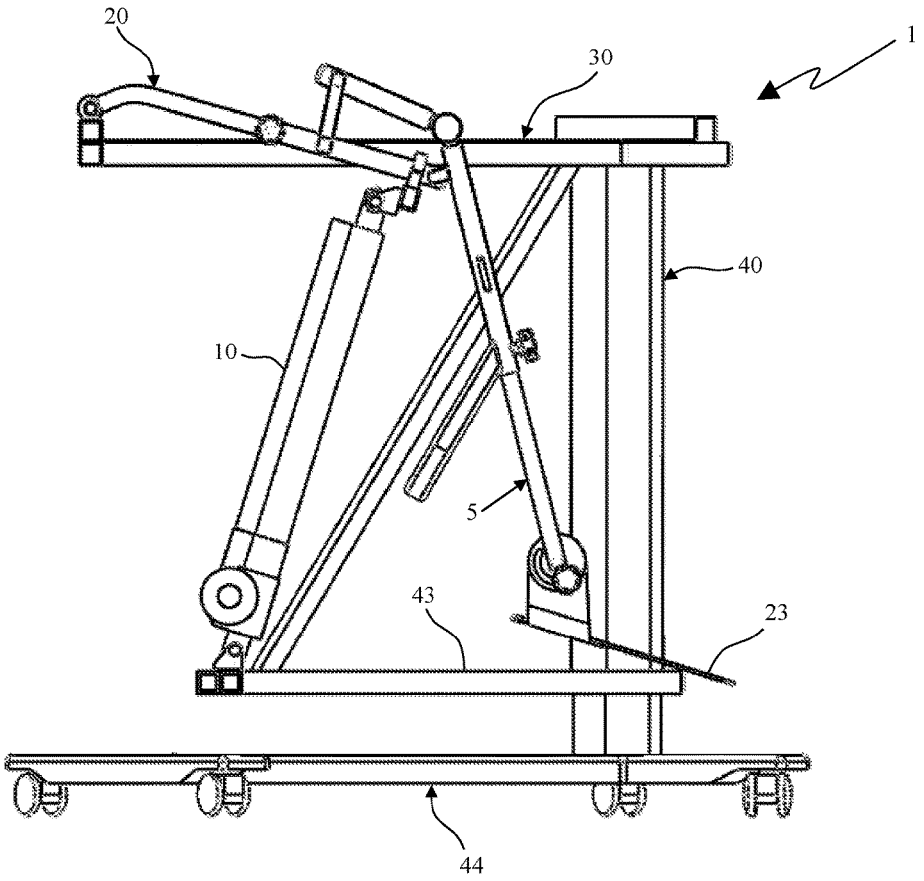
FIGS. 8A-8F are side views of an embodiment as the system progresses through its exemplary range of motion.
Figure 8B:
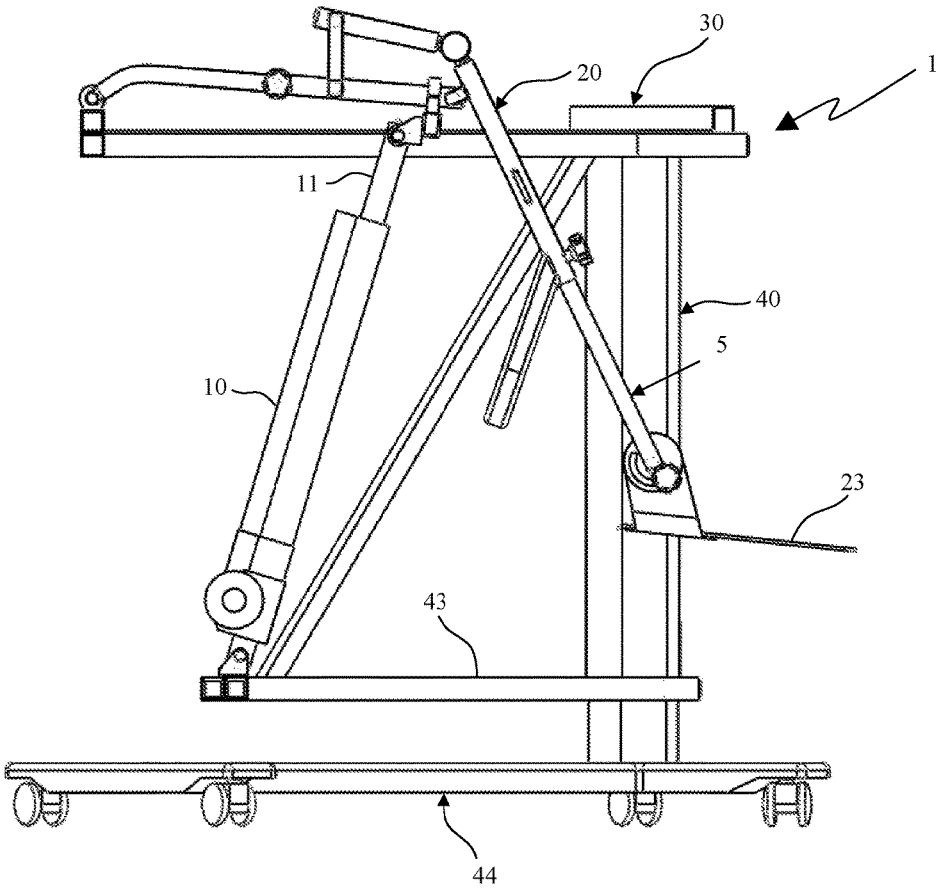
Figure 8C:
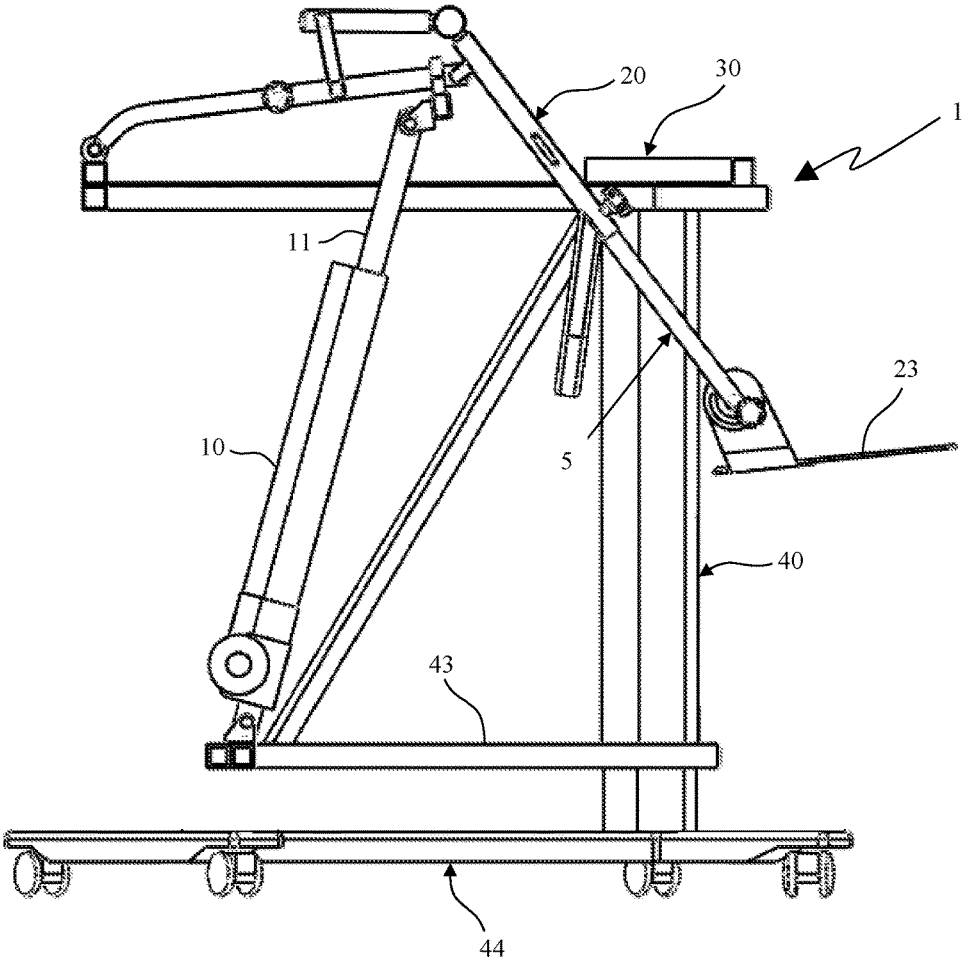
Figure 8D:
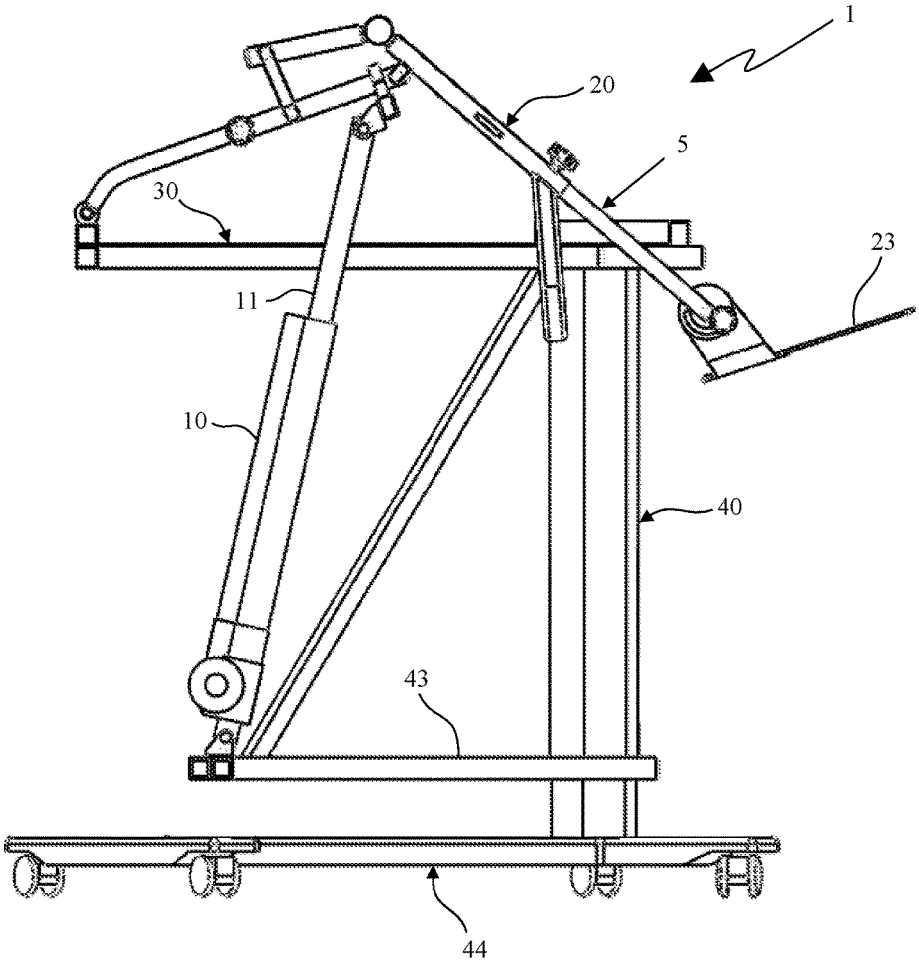
Figure 8E:
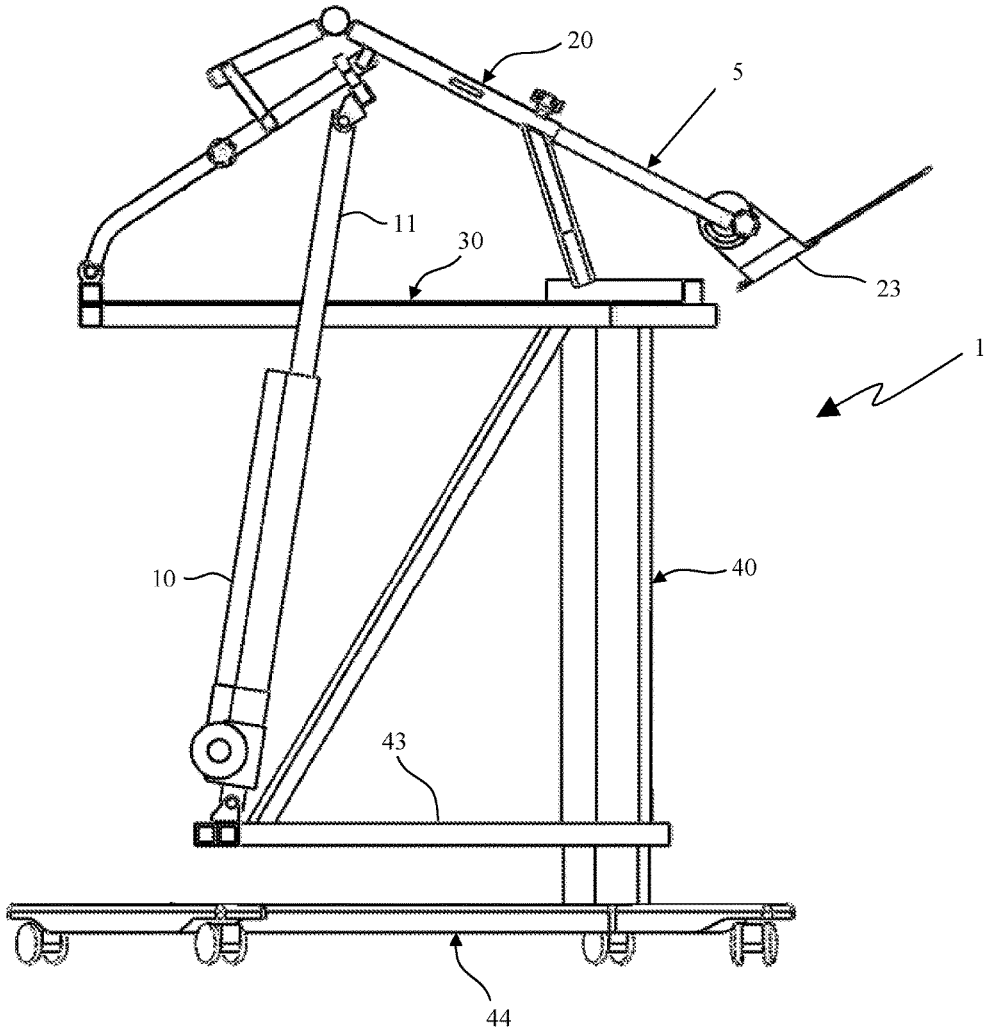
Figure 8F:
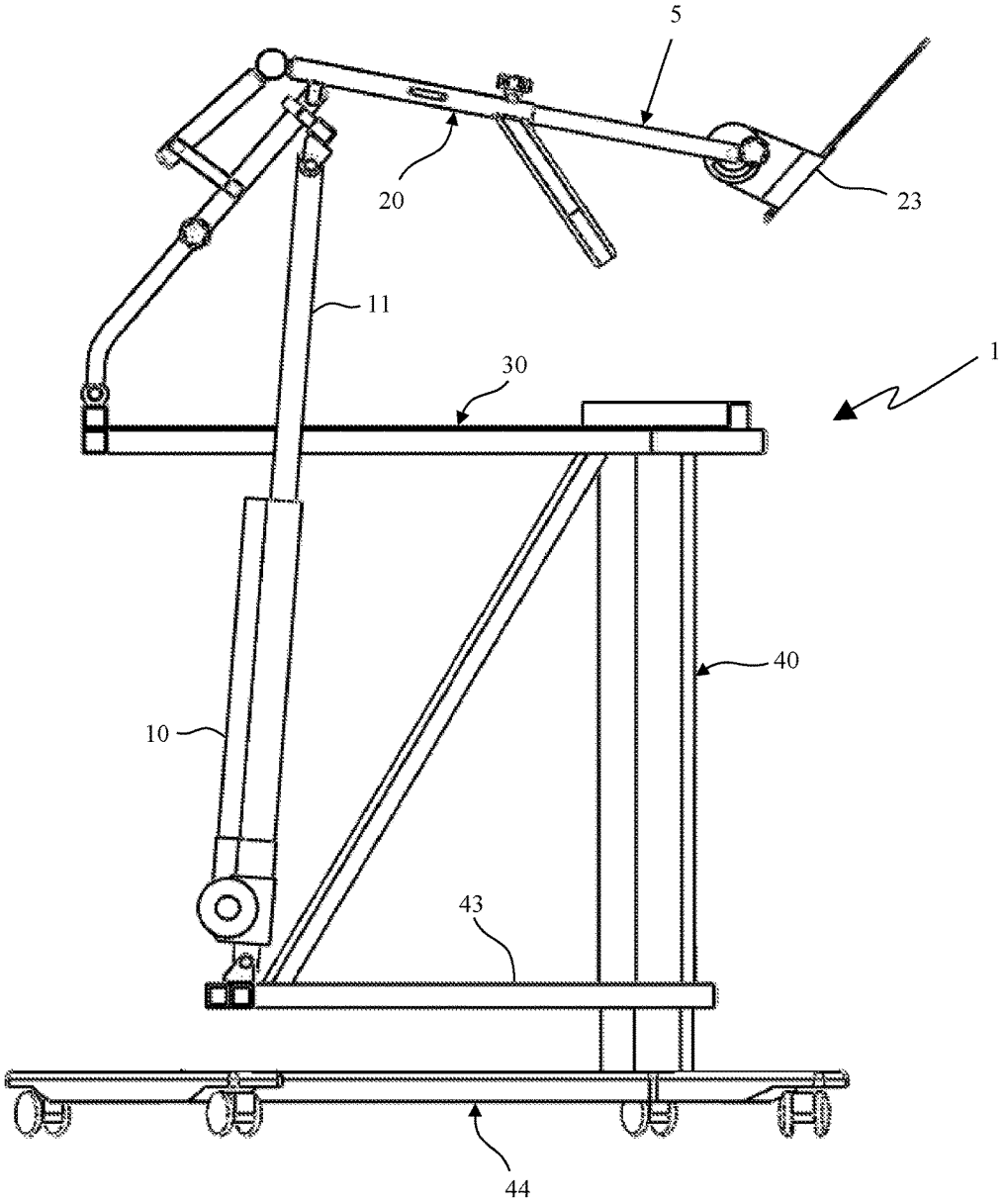

FIGS. 6 and 7 are front and rear views of an aspect of an embodiment of the system 1. These figures illustrate, for instance, a distinction between the foundation member 43 of the base 40 and the portable member 44. The portable member 44 can be incorporated into the foundation member 43 to form a single member.

FIGS. 8A-8F provide side views of an embodiment as the system 1 as it progresses through its range of motion. The range of motion for the device is approximately 60 degrees of flexion and 15 degrees of extension of the subject's hip. It should be appreciated that the range of motion, speed of motion, and repetition of motion may vary as desired or required.

Figure 9A:
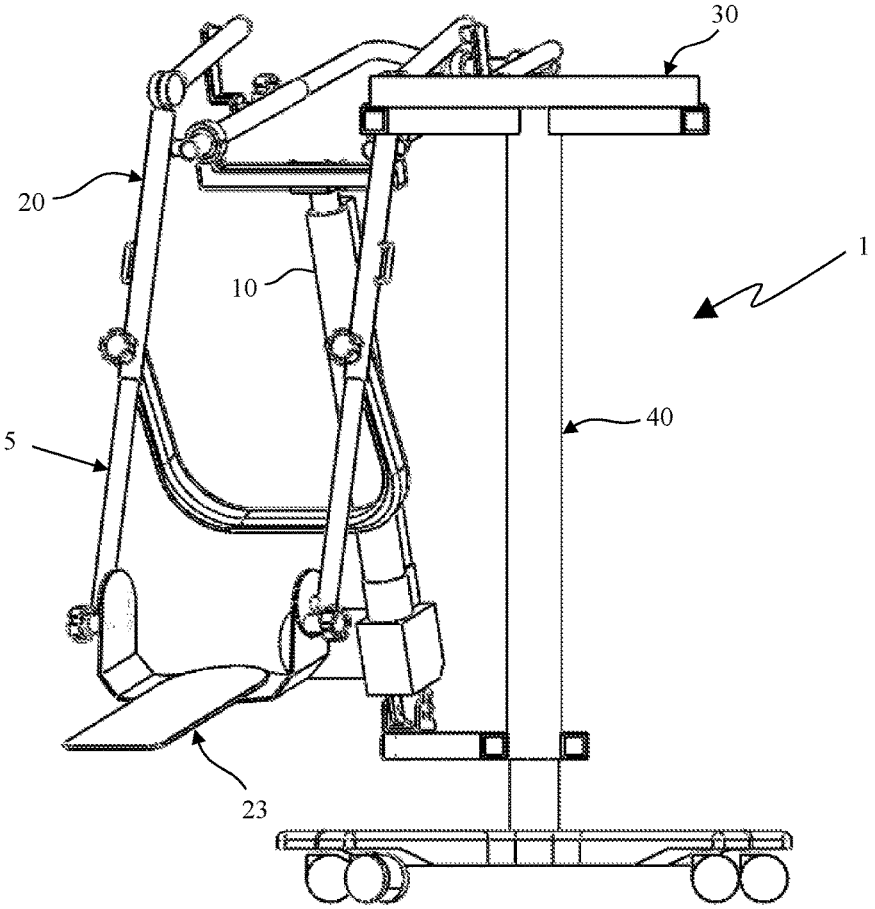
FIGS. 9A-9C are perspective views of an embodiment as the system progresses through its exemplary range of motion.
Figure 9B:
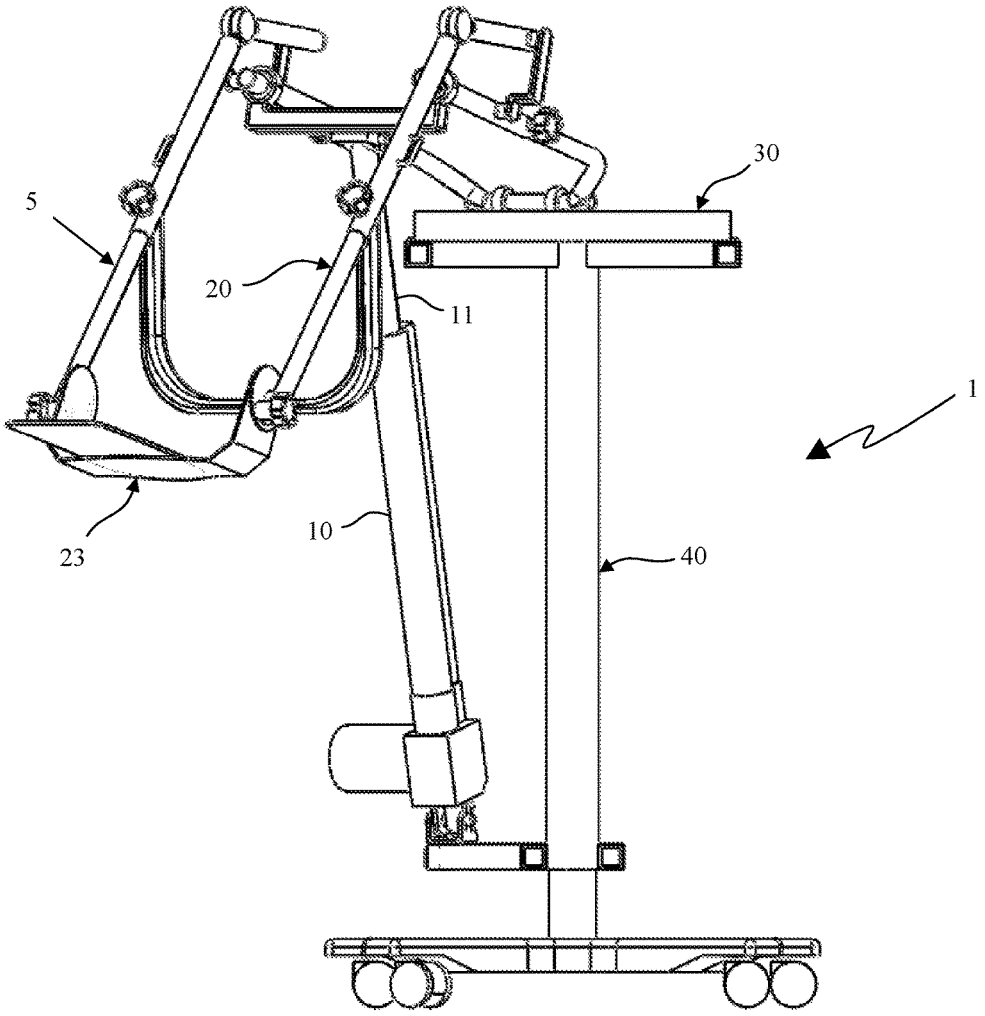
Figure 9C:
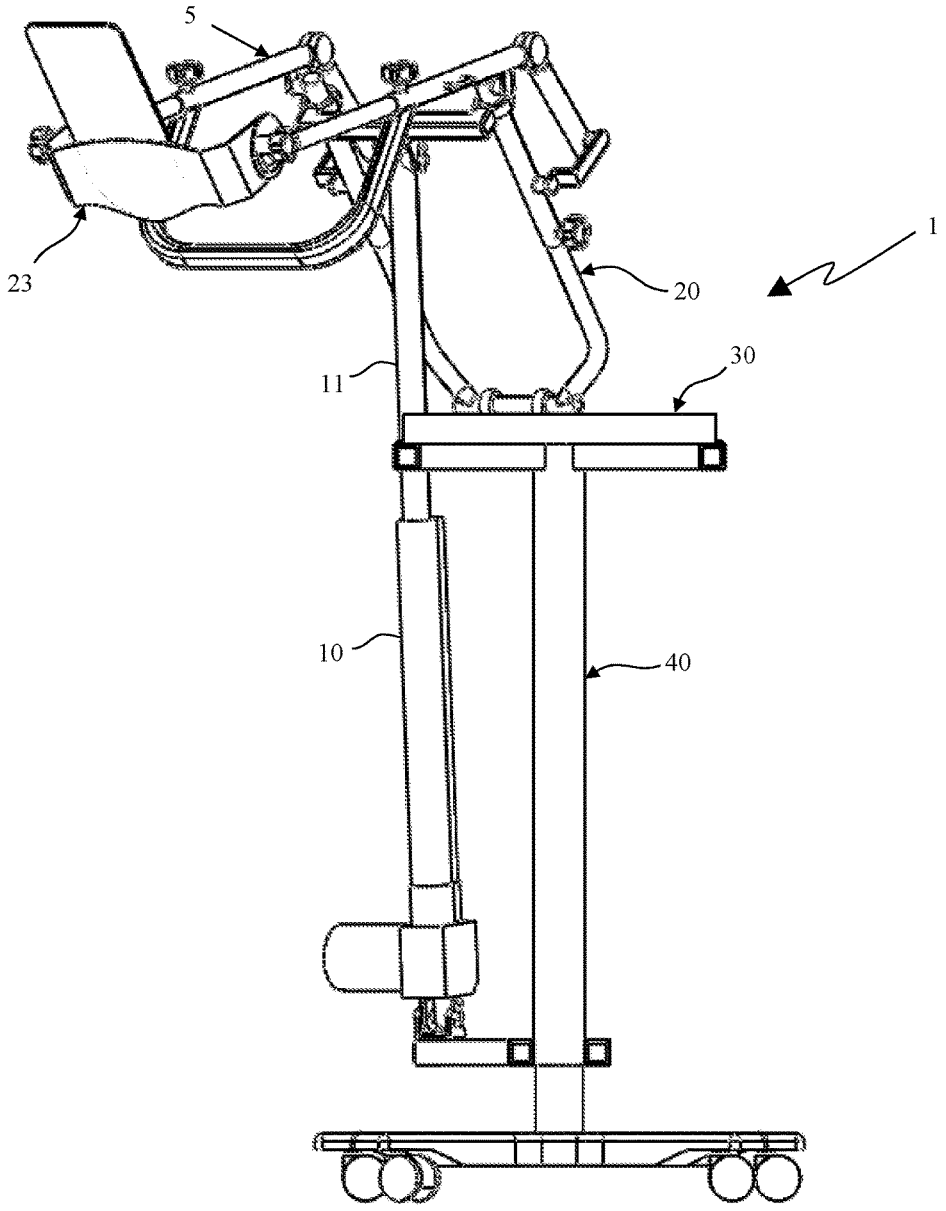

FIGS. 9A-9C provide perspective views of an embodiment as the system 1 progresses through its exemplary range of motion.

Figure 10A:
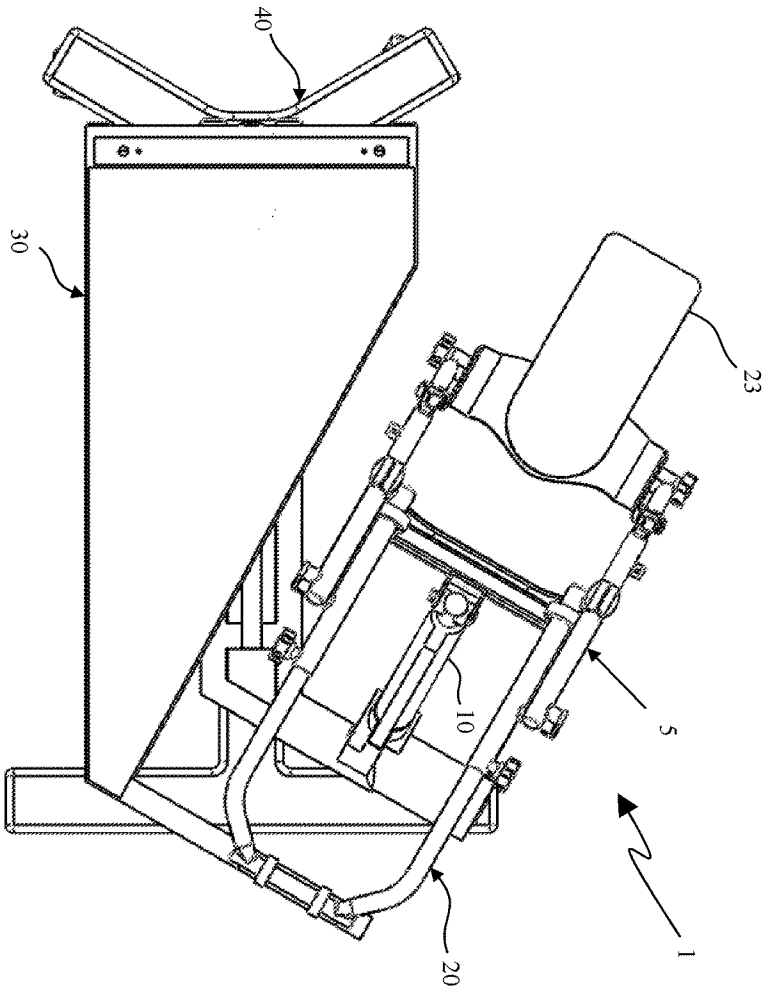
FIGS. 10A-10C are top views of an embodiment as the system progresses through it range of motion.
Figure 10B:
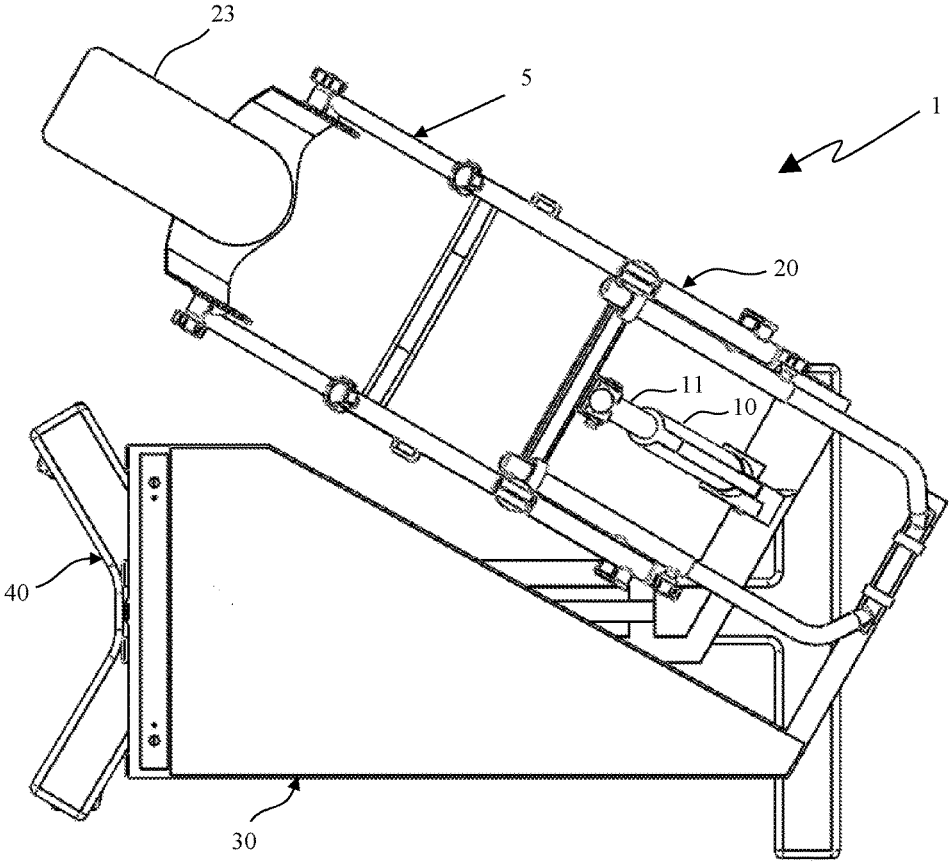
Figure 10C:
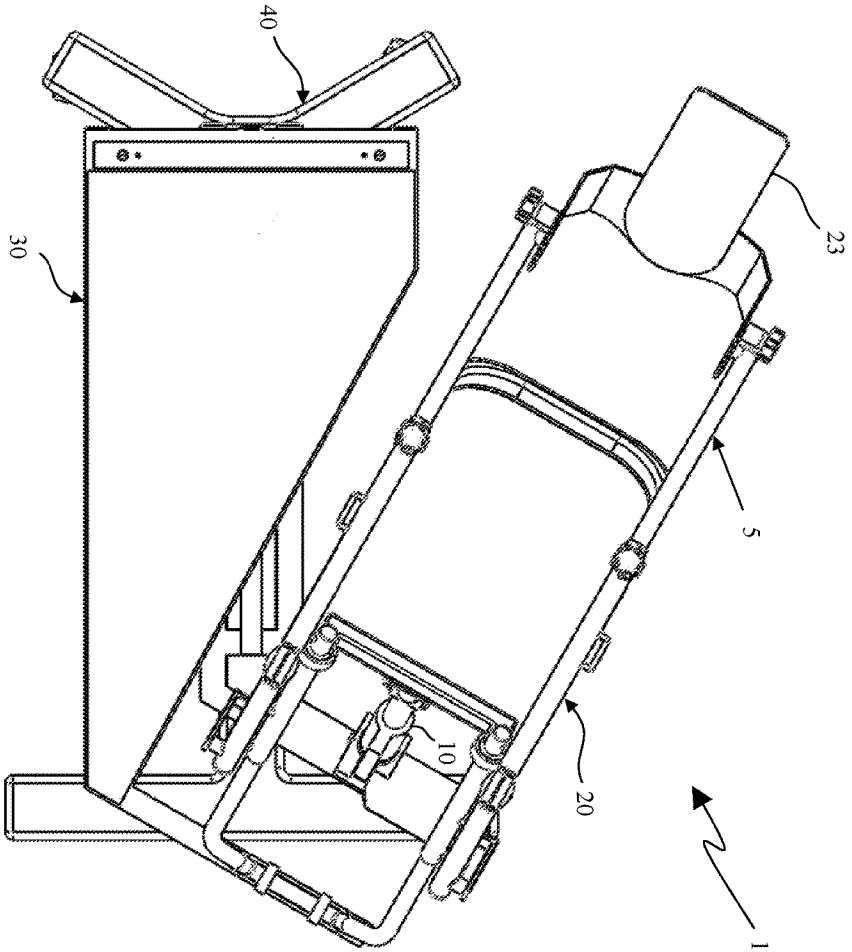

FIGS. 10A-10C provide top views of an embodiment as the system 1 progresses through it range of motion.

Figure 11A:
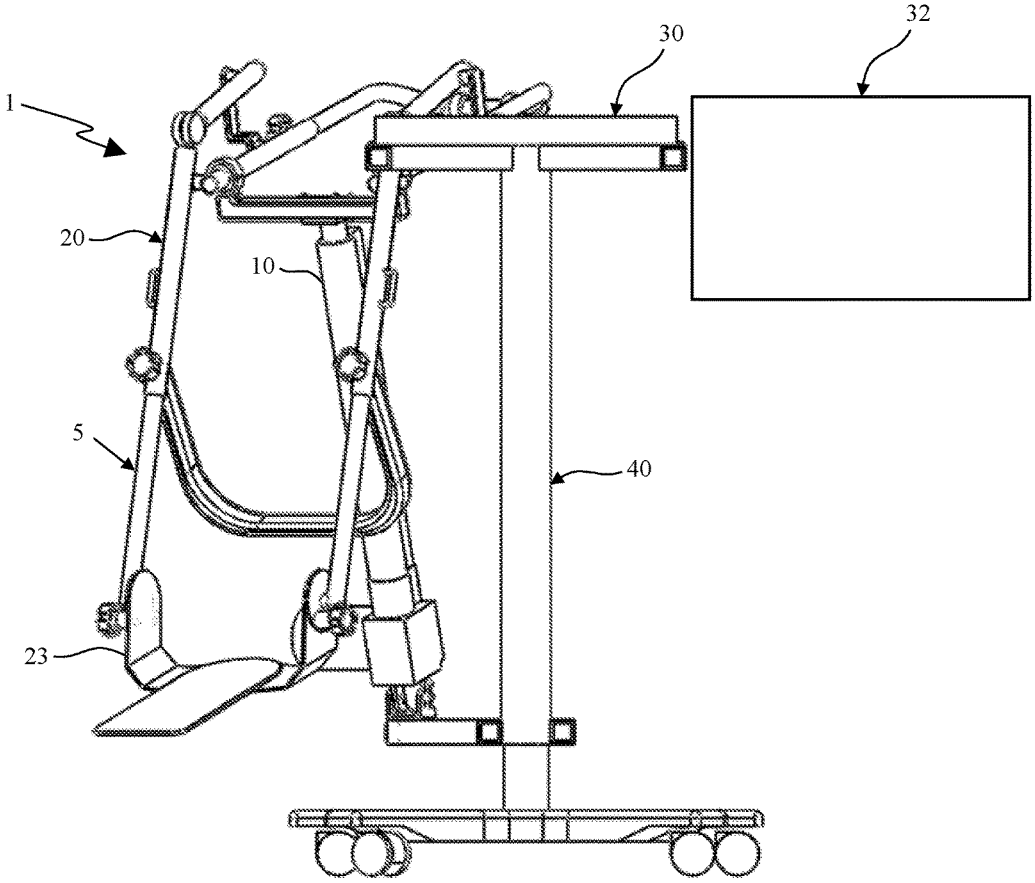
FIG. 11A shows an aspect of an embodiment of the system located next to a bed or other means for subject support.

FIG. 11A shows the system 1 located next to a bed 32 or other similar structure. For instance, such similar structure can be any means for a subject to rest while undergoing the rehabilitation, care or treatment including, but not limited to, a board, gurney, mattress, frame, surface, platform, ledge, shelf, offshoot, offset, extension, or pad. In this embodiment, the subject rests on the bed 32 (or similar structure) while the afflicted upper leg is placed in the support frame 20. The subject may wish to turn his entire body including the non-afflicted leg, so the retention surface 30 is intended to help support the subject's other leg during the rehab process. The device can be connected to the bed 32 (or similar structure) by any known means. Connecting the device to the bed helps stabilize the device.

FIG. 11A illustrates an embodiment system 1 whereby the subject would rest on a bed or similar device 32. The subject's upper leg is placed in the support frame 20. The subject can turn his entire body to line up with the device or simply offset his leg. The retention surface 30 helps support any part of the subject's body extending off the bed which is not placed in the support frame. This may include the subject's other leg. Once the correct leg is in the support frame, the subject or the subject's caregiver can operate the device using the control box 50 (for example, as shown in FIG. 3). The desired range of motion and speed are selected, and the subject's leg is then moved accordingly. While FIGS. 4-11 illustrate the system 1 to be aligned for moving the right leg of a subject it should be appreciated that the device can configured to be used with a subject's left leg as well. Modifying the device to accommodate the opposing side, for example, is within the scope of the present invention.

Figure 11B:
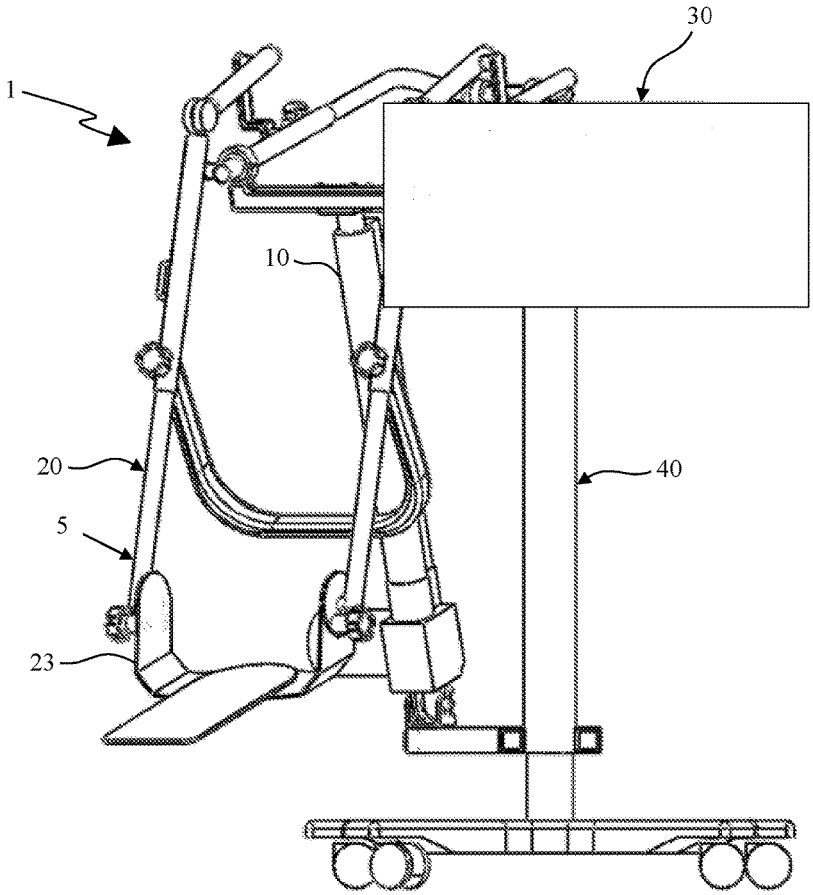
FIG. 11B shows an aspect of an embodiment of the system located wherein the retention surface may be part of the system.

FIG. 11B shows an aspect of an embodiment of the system 1 in which the retention surface 30 functions as a support for the patient's entire body. In this embodiment, there is no need for a separate bed 32 (or similar structure), i.e., retention surface itself shall suffice. Thus, the retention surface can be a board, gurney, mattress, pad, bed, frame, surface, platform, ledge, shelf, offshoot, offset, extension, or any structure as desired or required.

The devices, systems, compositions, computer program products, and methods of various embodiments of the invention disclosed herein may utilize aspects disclosed in the following references, applications, publications and patents and which are hereby incorporated by reference herein in their entirety:

1. U.S. Pat. No. 4,834,073, Bledsoe, et al., "Passive Motion Exerciser", May 30, 1989.

2. U.S. Patent Application Publication No. US 2002/0193710 A1, Main, et al., "Leg Stretching Apparatus", Dec. 19, 2002.

3. U.S. Pat. No. 5,325,849, Rugo, E., "Continuous Passive Motion Device", Jul. 5, 1994.

4. U.S. Pat. No. 4,520,827, Wright, et al., "NMS Added Continuous Passive Motion Apparatus", Jun. 4, 1985.

5. U.S. Pat. No. 5,280,783, Focht, et al., "Continuous Passive Motion Device for Full Extension of Leg", Jan. 25, 1994.

6. U.S. Patent Application Publication No. US 2010/0048364 A1, Reyes, G., "Hip Flexor", Feb. 25, 2010.

7. U.S. Pat. No. 4,509,509, Bouvet, et al., "Apparatus for Treating the Joints of the Human Body", Apr. 9, 1985.

8. U.S. Pat. No. 4,549,534, Zagorski, et al., "Leg Exercise Device", Oct. 29, 1985.

9. U.S. Pat. No. 4,665,899, Farris, et al., "Apparatus for Articulating the Knee and Hip Joints", May 19, 1987.

EXAMPLES

Practice of an aspect of an embodiment (or embodiments) of the invention will be still more fully understood from the following examples, which are presented herein for illustration only and should not be construed as limiting the invention in any way.

Example 1 includes a system for moving a subject's leg, whereby the system comprising: an apparatus configured to apply a moment of force to the subject's leg to rotate the subject's leg about the subject's hip; wherein the rotation provides for extension of the subject's hip.

Example 2 may optionally include the system of example 1, wherein the apparatus comprises a leg support member configured to support the subject's leg during the movement.

Example 3 may optionally include the system of example 2 (as well as subject matter of one or more of any combination of examples 1-2), wherein the leg support member comprises a support frame.

Example 4 may optionally include the system of example 3 (as well as subject matter of one or more of any combination of examples 1-3), wherein the support frame comprises: a proximal member; and a distal member.

Example 5 may optionally include the system of example 3 (as well as subject matter of one or more of any combination of examples 1-4), further comprising a foot rest.

Example 6 may optionally include the system of example 1 (as well as subject matter of one or more of any combination of examples 1-5), wherein the apparatus comprises an actuator, the actuator in communication with the apparatus generating the moment of force to provide movement of the apparatus.

Example 7 may optionally include the system of example 6 (as well as subject matter of one or more of any combination of examples 1-6), further comprising an arm, wherein the arm provides the communication between the actuator and the support member.

Example 8 may optionally include the system of example 2 (as well as subject matter of one or more of any combination of examples 1-7), wherein: the apparatus comprises an actuator, and the actuator is in communication with the leg support member to provide the movement of the leg support member generating the moment of force.

Example 9 may optionally include the system of example 8 (as well as subject matter of one or more of any combination of examples 1-8), further comprising a retention surface for supporting a portion of the subject other than the moving leg.

Example 10 may optionally include the system of example 1 (as well as subject matter of one or more of any combination of examples 1-9), wherein the retention surface is proximate to a bed.

Example 11 may optionally include the system of example 10 (as well as subject matter of one or more of any combination of examples 1-10), wherein the retention surface is proximate to a bed.

Example 12 may optionally include the system of example 10 (as well as subject matter of one or more of any combination of examples 1-11), wherein the retention surface is proximate to a board, gurney, mattress, frame, surface, platform, ledge, shelf, offshoot, offset, extension, or pad.

Example 13 may optionally include the system of example 10 (as well as subject matter of one or more of any combination of examples 1-12), wherein the retention surface is a bed.

Example 14 may optionally include the system of example 10 (as well as subject matter of one or more of any combination of examples 1-13), wherein the retention surface is a board, gurney, mattress, frame, surface, platform, ledge, shelf, offshoot, offset, extension, or pad.

Example 15 may optionally include the system of example 10 (as well as subject matter of one or more of any combination of examples 1-14), wherein the actuator is disposed on the retention surface or a base.

Example 16 may optionally include the system of example 1 (as well as subject matter of one or more of any combination of examples 1-15), wherein the moment of force to the subject's leg has a component that is rotational about the torso.

Example 17 may optionally include the system of example 1 (as well as subject matter of one or more of any combination of examples 1-16), wherein the moment of force provides a rotational component relative to the subject's hip throughout the entire range of motion of the extension of subject's hip.

Example 18 may optionally include the system of example 1 (as well as subject matter of one or more of any combination of examples 1-17), wherein the extension provides a range of motion as defined by a point below the subject's torso and a point parallel or about parallel with the subject's torso.

Example 19 may optionally include the system of example 18 (as well as subject matter of one or more of any combination of examples 1-18), wherein the moment of force provides a rotational component relative to the subject's leg throughout the entire range of motion of the extension of subject's hip.

Example 20 includes a method for moving a subject's leg, whereby the method comprises: applying a moment of force to the subject's leg to rotate the subject's leg about the subject's hip to provide for extension of the subject's hip.

Example 21 may optionally include the method of example 20, further comprising supporting a portion of the subject other than the moving leg.

Example 22 may optionally include the method of example 21 (as well as subject matter of one or more of any combination of examples 20-21), wherein the support is provided proximate to a bed.

Example 23 may optionally include the method of example 21 (as well as subject matter of one or more of any combination of examples 20-22), wherein the support is provided by a board, gurney, mattress, frame, surface, platform, ledge, shelf, offshoot, offset, extension, or pad.

Example 24 may optionally include the method of example 21 (as well as subject matter of one or more of any combination of examples 20-23), wherein the support is provided by a bed.

Example 25 may optionally include the method of example 20 (as well as subject matter of one or more of any combination of examples 20-24), wherein the moment of force to the subject's leg has a component that is rotational about the torso.

Example 26 may optionally include the method of example 20 (as well as subject matter of one or more of any combination of examples 20-25), wherein the moment of force provides a rotational component relative to the subject's hip throughout the entire range of motion of the extension of subject's hip.

Example 27 may optionally include the method of example 20 (as well as subject matter of one or more of any combination of examples 20-26), wherein the extension provides a range of motion as defined by a point below the subject's torso and a point parallel or about parallel with the subject's torso.

Example 28 may optionally include the method of example 27 (as well as subject matter of one or more of any combination of examples 20-27), wherein the moment of force provides a rotational component relative to the subject's leg throughout the entire range of motion of the extension of subject's hip.

Example 29 may optionally include the system of example 10 (as well as subject matter of one or more of any combination of examples 20-28), wherein the moment of force provides a rotational component relative to the vertical axis of said retention surface.

Example 30 may optionally include the system of example 10 (as well as subject matter of one or more of any combination of examples 20-29), wherein the extension is provided by a range of motion from the vertical axis of said retention surface.

Unless clearly specified to the contrary, there is no requirement for any particular described or illustrated activity or element, any particular sequence or such activities, any particular size, speed, material, duration, contour, dimension or frequency, or any particularly interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. It should be appreciated that aspects of the present invention may have a variety of sizes, contours, shapes, compositions and materials as desired or required.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. A system for moving a subject's upper leg configured to apply a moment of force to the subject's upper leg, said system comprising:

a retention surface, said retention surface generally having a width to define a retention surface lateral direction and a length to define a retention surface longitudinal direction;

a leg support member generally having a width to define a leg support lateral direction and a length to define a leg support longitudinal direction; wherein the leg support member longitudinal direction is offset at an angle laterally from the retention surface longitudinal direction;

said leg support member configured to be able to support the subject's leg during movement of said leg support member;

said retention surface being configured to be able to support the subject on said retention surface; and an actuator in communication with said leg support member to provide the movement of the leg support member, wherein the movement of the leg support member:

is aligned with the leg support longitudinal direction and offset from the retention surface longitudinal direction, and generates said moment of force to the leg support member to displace leg support member about the location of the subject's corresponding hip relative to said retention surface to define a retention surface-hip location so as to allow the leg support member to move posterior and anterior to a plane of the retention surface thereby providing for both extension and flexion of said leg support member relative to said retention surface-hip location.

2. The system of claim 1, wherein said leg support member is a support frame.

3. The system of claim 2, wherein said support frame comprises:

a proximal member; and a distal member.

4. The system of claim 2, wherein said support frame further comprising a foot rest.

5. The system of claim 1, wherein said actuator further comprising:

an arm, wherein said arm provides said communication between said actuator and said leg support member.

6. The system of claim 1, wherein said retention surface is proximate to a bed.

7. The system of claim 1, wherein said retention surface is proximate to a board, gurney, mattress, frame, platform, ledge, shelf, offshoot, offset, extension, or pad.

8. The system of claim 1, wherein said retention surface is a bed.

9. The system of claim 1, wherein said retention surface is a board, gurney, mattress, frame, platform, ledge, shelf, offshoot, offset, extension, or pad.

10. The system of claim 1, wherein said actuator is disposed on said retention surface or a base.

11. The system of claim 1, wherein the moment of force to the leg support member has a component that is rotational about said retention surface.

12. The system of claim 1, wherein the moment of force provides a rotational component relative to said retention surface-hip location throughout the entire range of motion of the extension and flexion.

* * * * *